United States Patent [19]

Price

[11] 4,280,421

[45] Jul. 28, 1981

[54] OPEN EDGE FOLDER

[76] Inventor: Elvin C. Price, 696 Camp Perrin Rd., Lawrenceville, Ga. 30245

[21] Appl. No.: 75,804

[22] Filed: Sep. 14, 1979

[51] Int. Cl.[3] ..... D05B 35/06

[52] U.S. Cl. ..... 112/147; 112/138

[58] Field of Search ..... 112/138, 147, 63, 148, 112/149

[56] References Cited

U.S. PATENT DOCUMENTS

| | | | |
|---|---|---|---|
| 1,207,977 | 12/1916 | Moffatt | 112/138 |
| 1,230,906 | 6/1917 | Krug et al. | 112/138 |
| 1,237,801 | 8/1917 | Moffatt | 112/138 |
| 1,562,446 | 11/1925 | Harn | 112/138 |
| 2,347,145 | 4/1944 | Ackerman | 112/138 |
| 4,128,066 | 12/1978 | Peloggio | 112/138 X |

*Primary Examiner*—Werner H. Schroeder
*Assistant Examiner*—Andrew M. Falik
*Attorney, Agent, or Firm*—Jones, Thomas & Askew

[57] ABSTRACT

As a web of material is guided along an L-shaped path toward a sewing station, the web is progressively folded in the first leg of the L-shaped path, and the web is refolded into a binding fold as it turns from the first leg to the second leg of the L-shaped path. The folder through which the web of material passes progressively shapes the web into the desired fold, and the folder is open along its upper edge so that if the material is too wide or irregularly shaped, the upper edge of the material can protrude out of the folder as the material is being folded along the first leg of the L-shaped path, and when the material is being refolded, the protruding edge of the web is folded into the binding fold.

4 Claims, 19 Drawing Figures

OPEN EDGE FOLDER

FIELD OF THE INVENTION

This invention relates to a folder for manipulating textile work products such as elongated webs of material as they are guided and folded into a binding fold and moved together with an insert toward a sewing machine for connection.

BACKGROUND OF THE INVENTION

When garments are fabricated from knitted or other stretchy materials the sewing machine operators are required to exercise extra care and accuracy during the sewing function so as to properly form and connect the materials together. For example, when a binding, such as a collarette is to be formed from a web of knitted material and sewn to a garment piece, the material must be folded into the binding fold configuration and the other garment piece inserted into the folded over web. This procedure should take place without stretching one of the garment pieces more than the other garment piece in order to avoid wrinkling or "puckering" one of the pieces at their line of connection. A folder is usually employed to form the collarette into a binding fold, as by forming a preliminary fold and then turning the binding material through an angle toward the sewing machine and everting the preliminary fold into the binding fold. As the preliminary fold is everted, the workpiece is inserted into the binding fold and the two pieces are then pulled by the sewing machine on into the needle.

Various folders have been used in the past which are shaped to form the web of material in the proper folded configuration. Examples of prior art disclosures of folders are found in U.S. Pat. Nos. 2,026,484, 3,134,347, 3,595,187, 3,776,156 and in West German Pat. No. 1,813,422.

While the prior art folders have functioned successfully in that they progressively form web material into a folded configuration as the material approaches a sewing station, the prior art folders and the workpiece must be accurately matched in size in order for the folder to function correctly. For example, if the folder is designed for receiving a web of material that is one and one-half inches wide and for folding the web into a binding which is five-eighths inch wide, and if the material is cut to an excessive width of one and three-fourths inches wide, the material will not pass through the folder, or if the material does pass through the folder the folder will not properly form the material and the material tends to drag and stretch inside the folder and form an improper collarette on the final work product. This requires the manufacturer to discard or to recut the oversized binding material to the proper size.

In many instances it is impossible to recut binding material that is slightly wider than the desired width, and the binding material must be discarded or used for some other purpose. The manufacturer is then required to obtain more binding material to finish the previously cut garments. The supplementary binding material usually is obtained from a different dye lot, and in most instances the supplementary material will not match the color of the original material when the final work product is assembled.

In some instances it would be possible to use the overcut binding material if another folder were available for the job. For example, the manufacturer may have in his stock a one and three-fourths inch binder folder that folds a web to a five-eighths inch wide binding that he can use as a substitute for the one and one-half inch folder, and he therefore can solve his problem with the overcut binding material. However, solving the problem in this manner requires the manufacturer to stock a multiple number of folders and to change the folders from one run to the next when it is discovered that the binding material is supplied in different widths.

SUMMARY OF THE INVENTION

Briefly described, the present invention comprises a folder for guiding and progressively folding a web of material, such as a web of knitted material to be used as a collarette about the neck opening of a knitted shirt or at other locations in a garment structure. The web of material is moved from a supply along an L-shaped path toward a sewing machine and a preliminary fold is progressively formed in the web as it moves along a first leg of the L-shaped path. The web is turned at an angle to move along the second leg of the L-shaped path on into the sewing station, and the preliminary fold is refolded or everted to form the binding fold as the web is turned from the first leg to the second leg of the L-shaped path. As the binding fold is formed, a workpiece is inserted into the binding and the feed dogs of the sewing machine pull the composite workpiece on into the needle.

The folder comprises an elongated structure that includes a fold plate and a cover plate oriented in approximately an upright attitude in overlying spaced relationship and joined together at their lower edges, with their inlet end and outlet ends and upper edges remaining open for the passage therebetween of the web of knitted material. If the knitted material is wider than the folder, the upper edge of the knitted material can protrude upwardly through the open upper edge of the folder, and when the material changes direction to pass through the second leg of the L-shaped path, the upper protruding edge of the knitted material will be folded inwardly in the collarette fold. In this manner, the oversized width of the binding material accumulates inside the fold of the collarette, without requiring the manufacturer to recut the oversized material or to replace the folder to accommodate the oversized material.

Thus, it is an object of this invention to provide a folder for use with a sewing machine and the like which accurately and expediently folds a web of material into a collarette fold and which accommodates an oversized width of the material.

Another object of this invention is to provide a folder for use in forming a web of material into a binder for neck openings, etc. of garments, wherein the web of material is properly folded to the desired size even though the web of material is overcut in width.

Other objects, features and advantages of the present invention will become apparent when reading the following specification, when taken in conjunction with the accompanying drawings.

DETAILED DESCRIPTION

Figure 1:
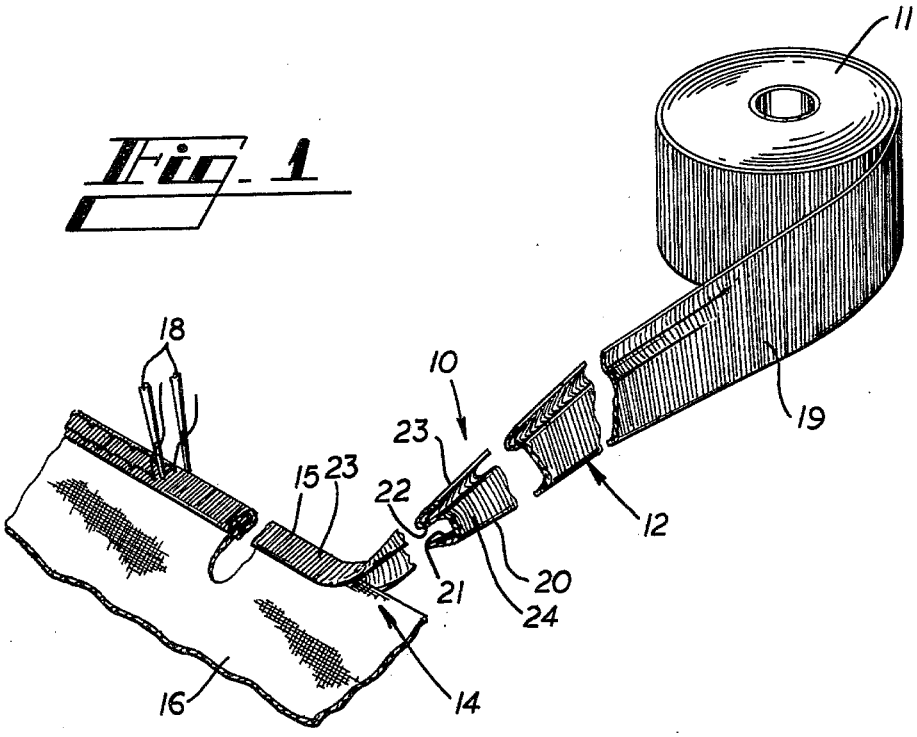
FIG. 1 is a schematic perspective illustration of the manner in which the web of material is progressively folded as it is moved along an L-shaped path toward a sewing machine, illustrating the manner in which the work product is formed as it approaches the sewing machine.

Referring now in more detail to the drawings, in which like numerals indicate like parts throughout the several views, FIG. 1 illustrates the manner in which a web of material 10 moves progressively from a supply such as reel 11 and is progressively folded as it moves through the first leg 12 of an L-shaped path, is everted as it turns the angle at 14 and moves through the second leg 15 of the L-shaped path. The work product 16 is joined with the web 10 at the angle 14, by inserting the edge portion of the work product 16 into the binding fold, so that a collarette-type binding is sewn in the composite work product at the sewing machine 18.

The web 10 is progressively folded in the first leg of the L-shaped path, for example into an S-shape or into a W-shape. For example, the web 10 progressively moves from a substantially flat configuration at 19 into an S-shape at 20, wherein it includes a lower fold 21, an intermediate fold 22, and an upper fold 23. As the web 10 moves on further to the angle 14, the span of the material 24 between lower fold 21 and intermediate fold 22 progressively disappears. When the web is everted at angle 14, the lower fold is everted in a counterclockwise direction while the intermediate and upper folds 22 and 23 are everted in a clockwise direction, and the work product 16 is received between lower fold 21 and upper fold 23.

Figure 2:
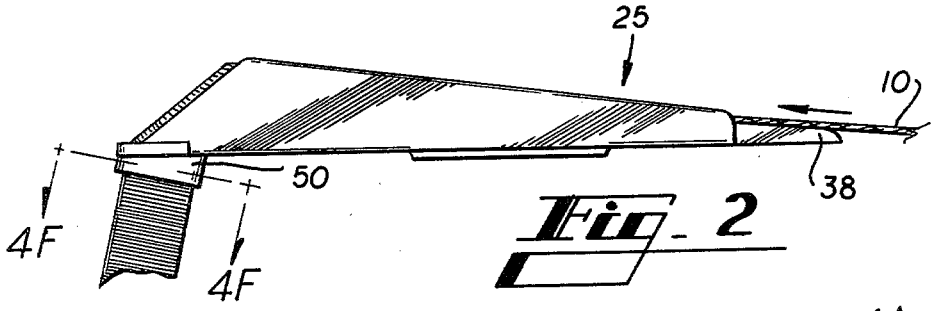
FIG. 2 is a side elevational view of the folder used to fold material illustrated in FIG. 1.
Figure 3:
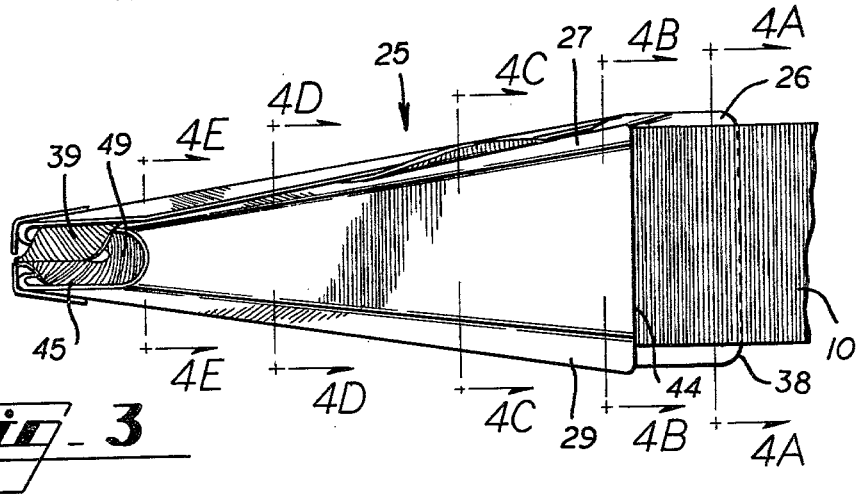
FIG. 3 is a top view of the folder.
Figure 4A:
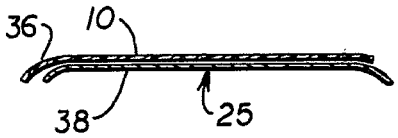
FIGS. 4A—4F are progressive cross sectional illustrations of the folder and the material as it passes through the folder, taken along lines 4A—4F of FIG. 3.
Figure 4B:
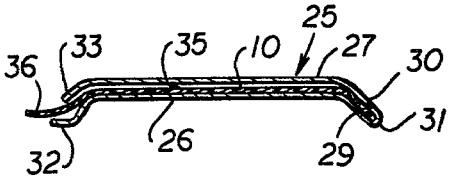
Figure 4C:
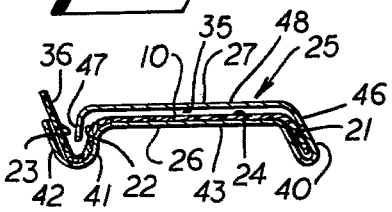
Figure 4D:
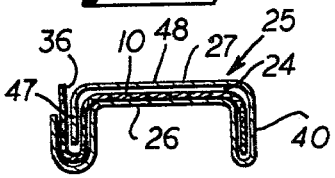
Figure 4E:
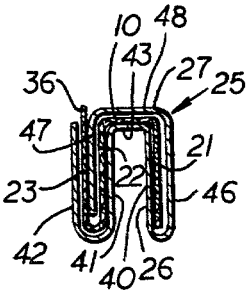

As illustrated in FIGS. 2 and 3, folder 25 comprises a guide plate 26 and a cover plate 27 that are arranged in juxtaposed overlying relationship. As illustrated in FIG. 4B, guide plate 26 and cover plate 27 are joined at their lower edges 29 and 30 in a folded closed edge 31, and remain open at their upper edges 32 and 33. The guide plate and cover plate 26 and 27 merge progressively from flat configurations (FIG. 4B) toward a nested folded configuration (FIG. 4E), and a passageway 35 is formed between the guide plate and cover plate. Thus, the passageway progressively merges from a substantially flat configuration to the folded, S-shaped configuration. By the time the web of material 10 reaches the portion of folder 25 as illustrated by FIG. 4E, the web will have been formed into an S-shape that includes the lower fold 21, intermediate fold 22 and upper fold 23, with the span of material 24 between lower fold 21 and intermediate fold 22 having been reduced progressively as the material passes through the folder. In the event that the width of the web of material 10 is more than the width of folder 25, the upper edge 36 of the web of material can protrude through the space between the upper edges 32 and 33 of the guide plate 26 and cover plate 27.

Guide plate 26 progressively merges from a progressively flat configuration at its inlet end 38 toward its outlet end 39, and progressively forms a lower wall 40, an intermediate wall 41, and an upper wall 42, with a spanning wall 43 disposed between lower wall 40 and intermediate wall 41. The spanning wall is progressively diminished in height from the inlet end 38 toward the outlet end 39 as the lower, intermediate and upper walls are progressively increased in their dimensions from the inlet end 38 toward the outlet end 39. The cover plate 27 is also progressively folded from its inlet end 44 toward its outlet end 45 and nests with guide plate 26. Cover plate 27 includes lower wall 46 and upper wall 47, with spanning wall 48 located therebetween. The walls of cover plate 27 also progressively change in their dimensions from their inlet ends toward their outlet ends.

Figure 4F:
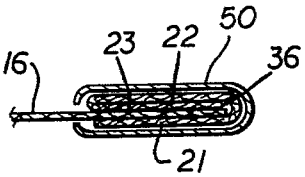

Guide plate 26 terminates at an obtuse angle at its outlet end with respect to the passageway formed between guide plate 26 and cover plate 27 and forms an outlet opening 49 between its lower wall 40 and intermediate wall 41. A U-shaped extension 50 is formed with respect to outlet opening 49 and guides the web of material along the second leg of its L-shaped path toward the sewing machine. As the web of material is pulled through the folder gravity tends to pull the web downwardly until its lower edge moves in contact with the closed lower edge portions of guide plate 26 and cover plate 27. When the web of material emerges from the outlet opening 49 and turns the angle between the first and second legs of the L-shaped path, the web of material is everted into a binding fold (FIG. 4F), and the work product 16 is inserted between the lower fold 21, intermediate fold 22 and upper fold 23. It will be noted that the upper fold 23 becomes the inside fold of the final product while the intermediate fold 22 becomes the outside fold.

Figure 4G:
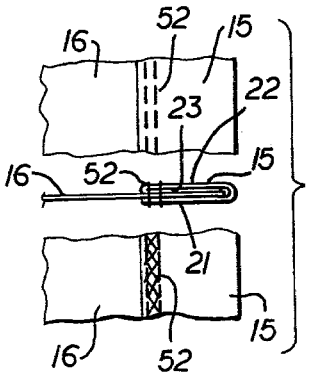
FIG. 4G is a schematic composite illustration of the work product, showing the work product in cross section, top plan view and in bottom plan view, after the binder has been applied to the work product.

As the composite work product moves on into the sewing machine, the needles 18 of the sewing machine sew through the work product. An example of the stitching formed in the work product is illustrated in FIG. 4G, wherein a cover stitch is illustrated. The particular fold configuration is formed by the folder of FIGS. 2 and 3 is known as the "BSb". Of course, other stitch formations can be made, as may be desired.

In the event that the width of the web of material 10 is less than that illustrated in the drawing, the upper fold 23, which eventually becomes the inner fold (FIG. 4F) will be shorter while the lower and intermediate folds 21 and 22 will remain constant in dimension. Therefore, the width of the web of material 10 can vary from a dimension which forms the fold with a very small upper fold to a dimension which forms the product with a very wide upper fold 23.

Figure 5:
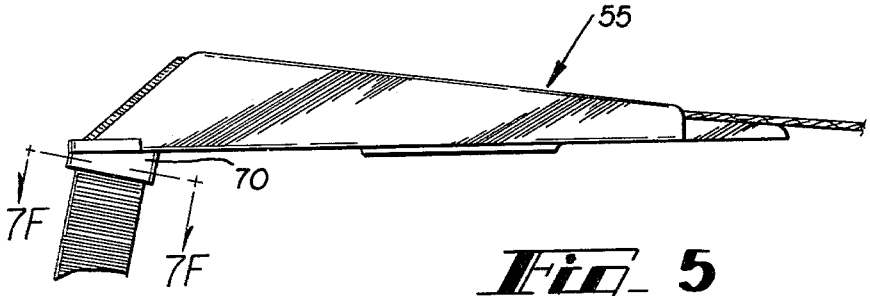
FIG. 5 is a side view of a folder, similar to FIG. 2, but illustrating a modified form of the invention.
Figure 6:
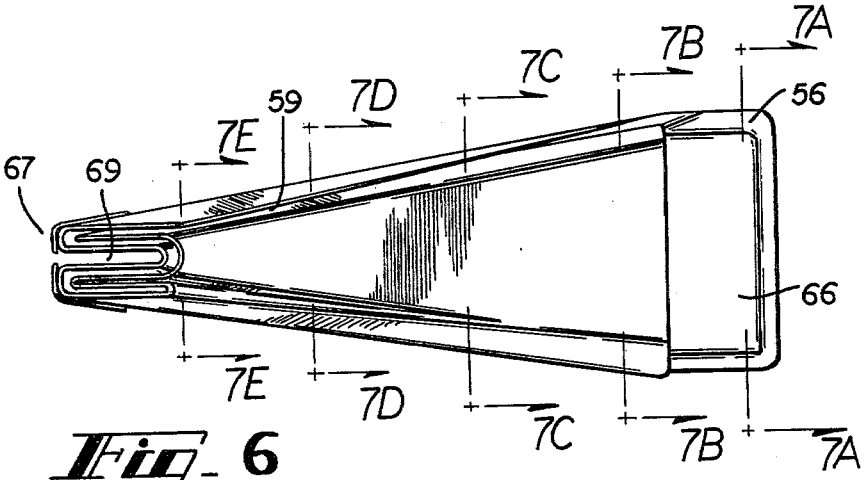
FIG. 6 is a top view of the folder of FIG. 5.

Referring now to FIGS. 5–7, the folder 55 is similar to folder 25 except that it is structured to form an additional fold in the work product. Guide plate 56 and cover plate 57 are arranged in overlying juxtaposition to form a passageway therebetween and guide plate and cover plate 26 and 27 progressively merge in nested relationship from a substantially flat configuration to a W-shape, with the upper edge 59 of the W-shaped passage remaining open. Thus, the web of material 10 merges into a configuration that includes a lower fold 59, lower intermediate fold 60, upper intermediate fold 61, and upper fold 62, with the upper edge 64 of the web of material being allowed to protrude from the upper open edge 59 of the folder. The span of material 65 between lower and upper intermediate folds 60 and 61 progressively diminishes as the material progresses from the inlet end 66 to the outlet end 67 of the folder. The outlet opening 69 is also formed at an obtuse angle with respect to the passageway formed between guide plate 56 and cover plate 57, and U-shaped outlet extension 70 guides the material away from folder 55.

Figure 7A:
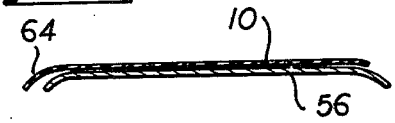
FIGS. 7A—7F are progressively cross sectional views of the folder and the material passing through the folder.
Figure 7B:
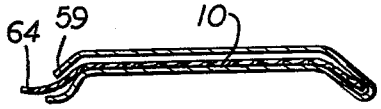
Figure 7C:
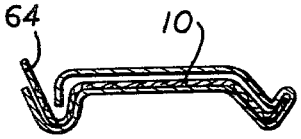
Figure 7D:
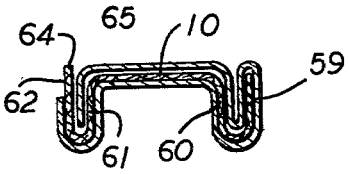
Figure 7E:
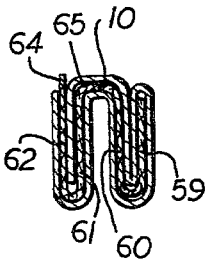
Figure 7F:
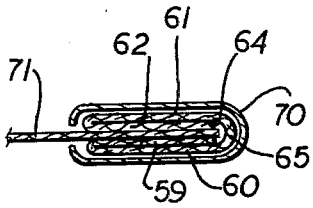
Figure 7G:
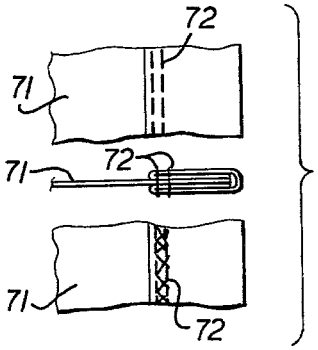
FIG. 7G is a schematic composite illustration of the composite work product, showing a side cross sectional view, a top view and a bottom view thereof.

As the web of material 10 moves about the outlet end 69 of the guide plate 56 and is everted, the lower and upper folds 59 and 62 are folded inwardly while the lower intermediate fold and upper intermediate fold 60 and 61 form the outside of the binding (FIG. 7F). The work product 71 is inserted between the lower and upper folds 59 and 62, now the inside folds. As illustrated in FIG. 7G, a double needle sewing machine can connect the folds together, as by using a cover stitch or other suitable stitch 72.

As with the embodiment illustrated in FIGS. 2–4, the embodiment illustrated in FIGS. 5–7 permits the upper edge 64 of the web of material 10 to protrude from the upper opening formed along the folder 55, so that wide material can be accommodated in the folder. As illustrated in FIG. 7F, the protruding edge 64 is formed as an extra width of material inside the binder. On the other hand, if the web of material 10 is cut to a narrower dimension, the upper edge 64 of the web will not protrude from the folder, and the final binding will have less material in its upper fold 62, which is the final upper inside fold of the binder.

While this invention has been described in specific detail with particular reference to a preferred embodiment thereof, it will be understood that variations and modifications can be effected within the spirit and scope of the invention as described hereinbefore and as defined in the appended claims.

We claim:

1. A folder for guiding a web of binding material from a flat configuration into a folded configuration as the web moves through the folder from its inlet end to its outlet end toward a sewing machine or the like comprising an elongated guide plate assembly normally extending in a horizontal attitude and including a guide plate and a cover plate in juxtaposed overlying vertical attitude closed together along their bottom edges and open at their inlet ends and their outlet ends and continuously open along their top edges from the inlet ends to the outlet ends and defining a passage therebetween from the inlet end to the outlet end for a web of material, said guide plate and said cover plate at their inlet ends being substantially flat and oriented in a substantially upright attitude and forming a substantially flat passageway therebetween and merging toward the other end thereof into a folded configuration to progressively form the passageway into a folded shape with a lower fold having one edge adjacent the closed bottom edge of the guide plates, an intermediate fold, and an upper fold having one edge at the open top edges of the guide plate and cover plate, said guide plate terminating at an obtuse angle with respect to the passage between said guide plate and said cover plate and forming an outlet opening between the lower fold and the upper fold of the passageway, whereby binding material moves through the passageway and merges into a folded configuration and is everted as it moves about the obtuse angle and through the outlet opening, and if the binding material is wider than the height of the folder the upper edge of the binding material projects through the open top edge of said guide plate and cover plate.

2. A folder for guiding a web of binding material from a flat configuration into a folded configuration as the web moves through the folder from its inlet end to its outlet end toward a sewing machine or the like comprising an elongated guide plate assembly normally extending in a horizontal attitude and including a guide plate and a cover plate in juxtaposed overlying vertical attitude closed together along their bottom edges and open along their top edges and open at their inlet ends and their outlet ends and defining a passage therebetween from the inlet end to the outlet end for a web of material, said guide plate and said cover plate at their inlet ends being substantially flat and oriented in a substantially upright attitude and forming a substantially flat passageway therebetween and merging toward the other end thereof into a folded configuration, said guide plate being approximately S-shaped in cross section at the outlet end of said passageway, and said cover plate being approximately U-shaped in cross section at the outlet end of said passageway, with said guide plate and said cover plate being nested together to form the passageway in an S-shape at the outlet end of the folder with a lower fold having one edge adjacent the closed bottom edges of the guide plate and cover plate, an intermediate fold, and an upper fold having one edge at the open top edges of the guide plate and cover plate, said guide plate terminating at an obtuse angle with respect to the passage between said guide plate and said cover plate and forming an outlet opening between the lower fold and the upper fold of the passageway, whereby binding material moves through the passageway and merges into a folded configuration and is everted as it moves about the obtuse angle and through the outlet opening, and if the binding material is wider than the height of the folder the upper edge of the binding material projects through the open top edge of said guide plate and cover plate.

3. The folder of claim 1 and wherein the closed together bottom edges of said guide plate and said cover plate extend approximately in a horizontal attitude and the web of binding material is urged by gravity toward the closed bottom edges of said guide plate and cover plate.

4. A folder for guiding a web of binding material from a flat configuration as the web moves through the folder from its inlet end to its outlet end toward a sewing machine or the like comprising an elongated guide plate assembly normally extending in a horizontal attitude and including a guide plate and a cover plate in juxtaposed overlying vertical attitude closed together along their bottom edges and open along their top edges and open at their inlet ends and their outlet ends and defining a passage therebetween from the inlet end to the outlet end for a web of material, said guide plate and said cover plate at their inlet ends being substantially flat and oriented in a substantially upright attitude and forming a substantially flat passageway therebetween and merging toward the other end thereof into a folded configuration, said guide plate being approximately W-shaped in cross section at the outlet end of said passageway, and said cover plate being approximately S-shaped in cross section at the outlet end of said passageway, with said guide plate and said cover plate being nested together to form the passageway in a W-shape at the outlet end of the folder with a lower fold having one edge adjacent the closed bottom edges of the guide plate and cover plate, intermediate folds, and an upper fold having one edge at the open top edges of the guide plate and cover plate, said guide plate terminating at an obtuse angle with respect to the passage between said guide plate and said cover plate and forming an outlet opening between the lower fold and the upper fold of the passageway, whereby binding material moves through the passageway and merges into a folded configuration and is everted as it moves about the obtuse angle and through the outlet opening, and if the binding material is wider than the height of the folder the upper edge of the binding material projects through the open top edge of said guide plate and cover plate.

* * * * *